US010764663B2

(12) United States Patent
Wu et al.

(10) Patent No.: US 10,764,663 B2
(45) **Date of Patent: *Sep. 1, 2020**

(54) SPEAKER BOX

(71) Applicant: AAC Technologies Pte. Ltd., Singapore (SG)

(72) Inventors: Jun Wu, Shenzhen (CN); Kaihua Shen, Shenzhen (CN); Yue Ren, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,544

(22) Filed: Jul. 29, 2019

(65) Prior Publication Data

US 2020/0045397 A1 Feb. 6, 2020

(30) Foreign Application Priority Data

Aug. 2, 2018 (CN) ..... 2018 2 1242881 U

(51) Int. Cl.

| | |
|---|---|
| ***H04R 9/02*** | (2006.01) |
| ***H04R 1/28*** | (2006.01) |
| ***H04R 1/02*** | (2006.01) |
| *H04R 9/06* | (2006.01) |

(52) U.S. Cl.

CPC ..... *H04R 1/025* (2013.01); *H04R 1/021* (2013.01); *H04R 9/06* (2013.01); *H04R 2400/11* (2013.01); *H04R 2499/11* (2013.01)

(58) Field of Classification Search

CPC . H04R 9/06; H04R 9/02; H04R 1/025; H04R 1/021; H04R 2400/11; H04R 2499/11; H04R 9/16

USPC ..... 381/332, 386

See application file for complete search history.

(56) References Cited

U.S. PATENT DOCUMENTS 10,433,037 B2 * 10/2019 Li ..... H04R 1/2853

FOREIGN PATENT DOCUMENTS

| | | | | |
|---|---|---|---|---|
| CN | 207070332 | * | 3/2018 | ..... H04R 9/02 |
| CN | 207460510 | * | 6/2018 | ..... H04R 9/06 |

* cited by examiner

*Primary Examiner* — Vivian C Chin
*Assistant Examiner* — Ubachukwu A Odunukwe
(74) *Attorney, Agent, or Firm* — W&G Law Group LLP

(57) ABSTRACT

The present disclosure provides a speaker box which includes a shell, a speaker, an acoustic guiding channel, an auxiliary acoustic cavity, a baffle and a cover plate. The diaphragm of the speaker separates the receiving space into a front acoustic cavity and a rear cavity, the acoustic channel communicates the front acoustic cavity with the outside to form a front cavity. The auxiliary acoustic cavity is provided with a first through-hole in communication with the front cavity and a second through-hole in communication with the outside, and the baffle completely covers the first through-hole. The baffle is provided with a channel penetrating therethrough, and the auxiliary acoustic cavity is in communication with the front cavity through the channel. The cover plate completely covers the second through-hole and forms a fixed. Compared with the related art, the high-frequency acoustic performance of the speaker box of the present disclosure is excellent.

5 Claims, 3 Drawing Sheets

SPEAKER BOX

FIELD OF THE DISCLOSURE

The present disclosure relates to electro-acoustic transducers, and more particularly to a speaker box used in a portable electronic device.

DESCRIPTION OF RELATED ART

With the advent of the mobile Internet era, a drastically increasing number of smart mobile devices are being used. In all these mobile devices, mobile phones are most common and most portable mobile terminal devices. At present, mobile phones are powerfully in functionality. One of the powerful functions is the high-quality music function. Therefore, speaker boxes for playing music are widely applied to the conventional smart mobile devices.

A speaker box of the related art comprises a shell having a receiving space, a speaker accommodated in the shell and a acoustic guiding channel formed in the receiving space. The speaker comprises a diaphragm for vibrating and produce sound and via irradiation. The diaphragm partitions the receiving space into a front acoustic cavity and a rear cavity. The acoustic guiding channel communicates the front acoustic cavity with the outside, and cooperatively defines a front cavity with the front acoustic cavity.

However, in the speaker box in the related art, the anterior cavity has a space which is limited to a region rightly opposite to a dome and a region of the sound guide channel, and the structure is monotonous and may not be optimized. Therefore, high-frequency acoustic performance of the speaker box is subject to restrictions, and over-high high-frequency responses may cause harsh sounds, sharp dentilabial sounds and the like poor sound effects.

Therefore, it is desired to provide a speaker box to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
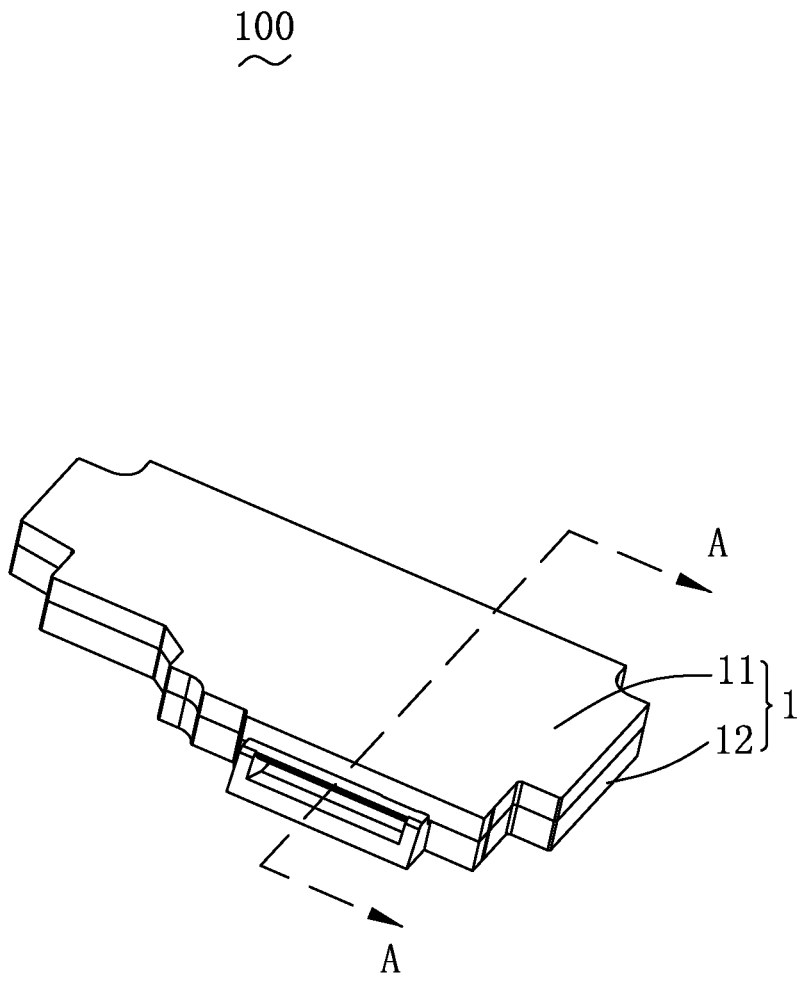
FIG. 1 is a three-dimensional diagram of structure of the speaker box in accordance with an exemplary embodiment of the present disclosure.
Figure 2:
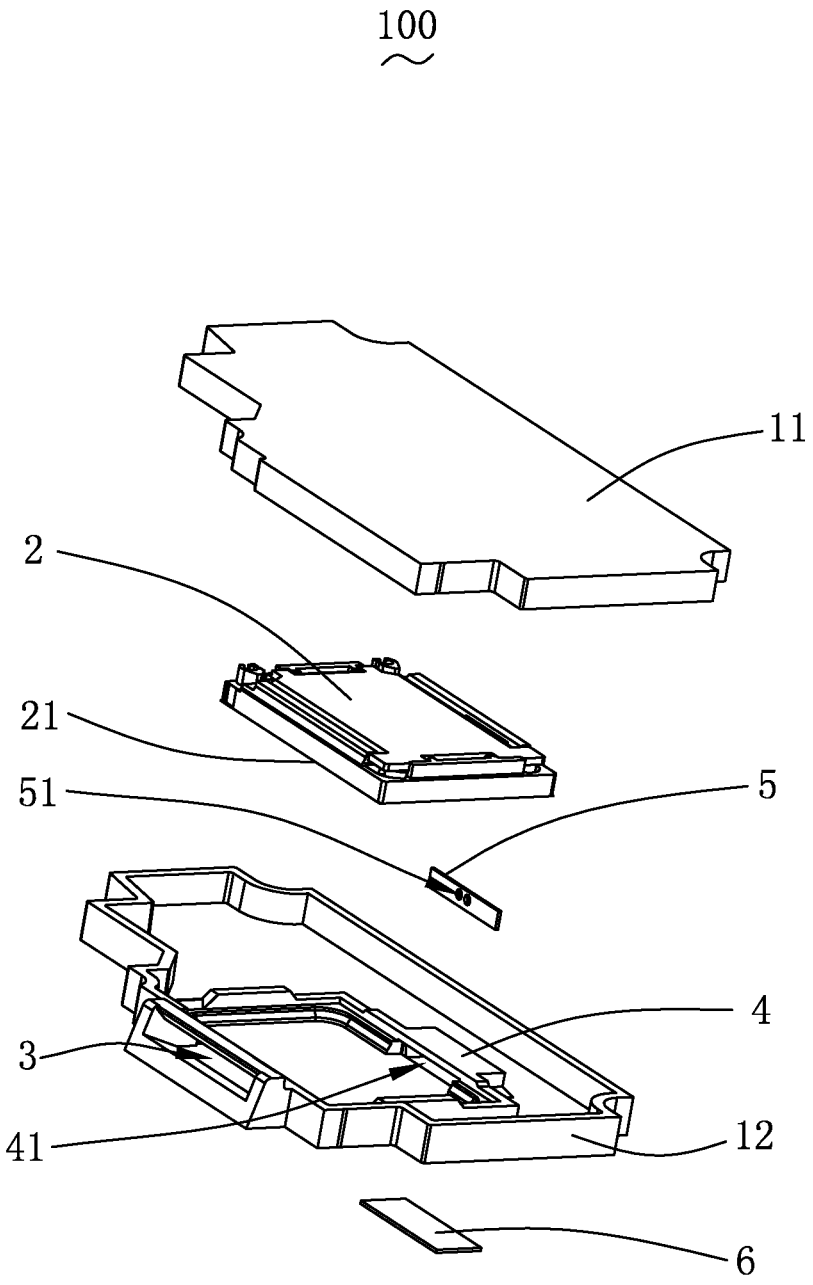
FIG. 2 is a partial three-dimensional perspective diagram of the structure of the speaker box exploded view.
Figure 3:
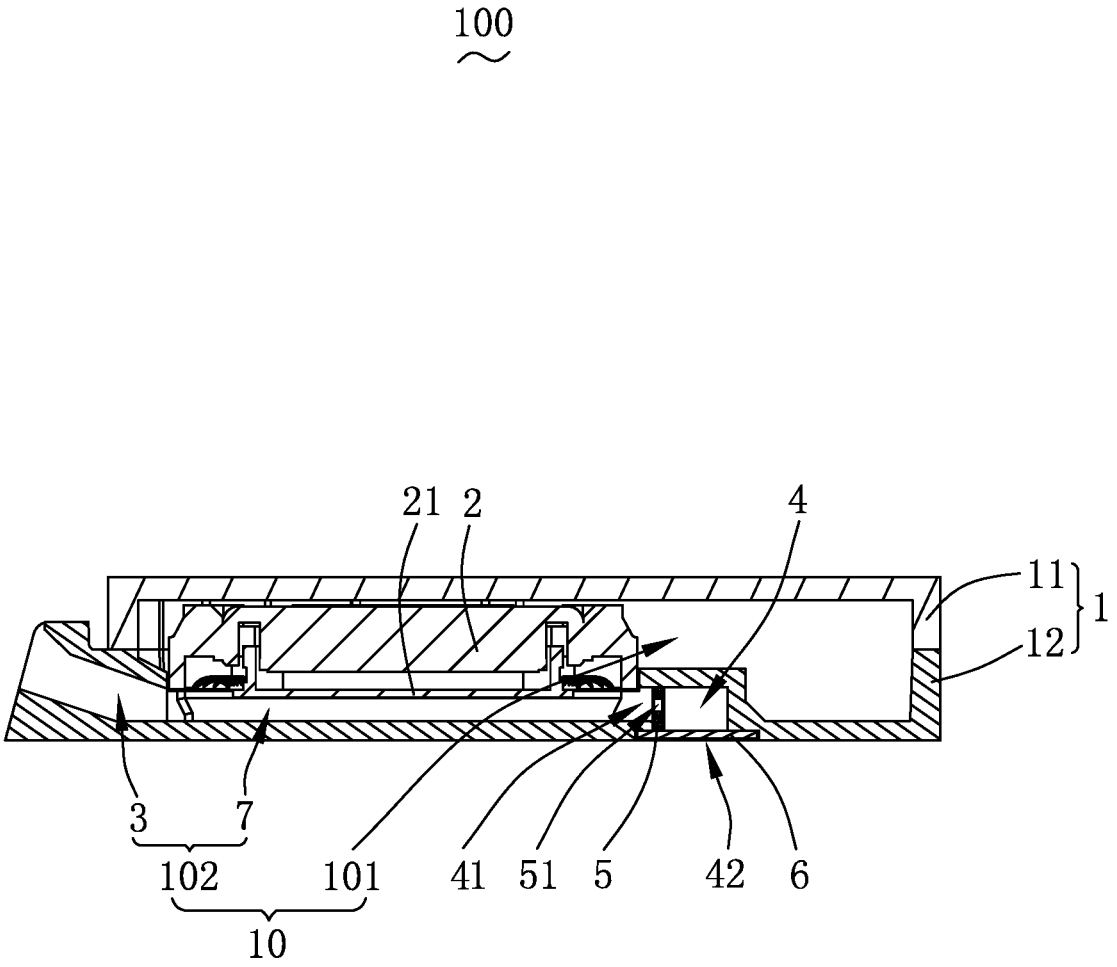
FIG. 3 is a cross-sectional diagram along the A-A line showing in FIG. 1.

Please refer to FIG. 1 to FIG. 3 together, wherein FIG. 1 is a three-dimensional structure diagram of the speaker box of the present disclosure, FIG. 2 is a partial three-dimensional perspective diagram of the speaker box exploded view, and FIG. 3 is a cross-sectional diagram along the A-A line showing in FIG. 1. The present disclosure provides a speaker box 100, which comprises a shell 1 having receiving space 10, a speaker 2, an acoustic guiding channel 3, an auxiliary acoustic cavity 4, a baffle 5 and a cover plate 6.

The shell 1 may be either formed integrally or be formed separately. For example, in this embodiment, the shell 1 comprises a lower cover 11 and an upper cover 12 covering with the lower cover 11 and cooperatively forming the receiving space 10 with the lower cover 11.

The speaker 2 is accommodated in the receiving space 10 of the Shell 1, and the speaker 2 partitions the receiving space 10 into a front acoustic cavity 7 and a rear cavity 101.

In this embodiment, the speaker 2 comprises a diaphragm 21 for producing sound via vibrating, wherein the diaphragm 21 partitions the receiving space 10 into the front acoustic cavity 7 and a rear cavity 101. In particular, the diaphragm 21 and the upper cover 12 are spaced apart from each other, and cooperatively form the front acoustic cavity 7, and the diaphragm 21, the upper cover 12 and the lower cover 11 cooperatively forms the rear cavity 101. The rear cavity 101 is designed to improve the low-frequency acoustic performance of the speaker box 100.

The acoustic guiding channel 3 is defined in the receiving space 10 of the shell 1. In this embodiment, the acoustic guiding channel 3 is disposed in the upper cover 12. The acoustic guiding channel 3 communicates the front acoustic cavity 7 with the outside and cooperatively defines a front cavity 102 with the front acoustic cavity 7. The acoustic guiding channel 3 is used to form a side sound radiating structure of the front cavity 102.

The auxiliary acoustic cavity 4 is formed in the receiving space 10, for example, formed in the upper cover 12. The auxiliary acoustic cavity 4 comprises a first through-hole 41 and a second through-hole 42, wherein the first through-hole 41 communicates with the front cavity 102 and the second through-hole 42 communicates with the outside.

The baffle 5 is provided with a channel 51 penetrating therethrough, and the auxiliary acoustic cavity 4 is in communication with the front cavity 102 through the channel 51. In this embodiment, the baffle 5 fully covers the first through-hole 41 and is fixed thereat. The baffle 5 partitions the front cavity 102 and the auxiliary acoustic cavity 4 into two cavities, and enables the auxiliary acoustic cavity 4 to be in communication with the front cavity 102 through the channel 51. That is, the auxiliary acoustic cavity 4 serves as a portion of the front cavity 102 and is used as a resonator of the front cavity 102.

In one aspect, the structure effectively increases a cavity volume of the front cavity 102 and improves the high-frequency acoustic performance, and in another aspect, the auxiliary acoustic cavity 4 has a more flexible structure design, is subject to less restriction and has more applicability.

In particular, the auxiliary acoustic cavity 4 is in communication with the front vocal cavity 7 through the channel 51. Nevertheless, the auxiliary acoustic cavity 4 may also be in communication with the acoustic guiding channel 3 through the channel 51, which is also practicable based on the same principle.

In the present embodiment, the channel 51 has at least one of a rectangle shape, a triangle shape, and a circle shape and the like. Of course, the shape of thereof is not limited thereto. The number of channel 51 is also unlimited, can be one or more, in this embodiment, the number of the channel 51 is two and the two channels 51 are spaced apart from each other.

With the structure design, the structure can be adjusted by adjusting the size of the channel 51 of the baffle 5 to achieve the damping size adjustment, so as to realize the high-frequency acoustic performance regulation of the speaker box 100, and enhance the diversification and flexibility of performance regulation thereof.

The cover plate 6 completely covers the second through-hole 42 and is fixed thereat. Thus, the auxiliary acoustic cavity 4 defines a sealed cavity structure to act as a resonator of the front cavity 102, and to realize the high-frequency acoustic performance adjustment of the front cavity 102. In the present embodiment, the cover plate 6 is made of a PET material and is certainly not limited to this material.

The structure design of the auxiliary acoustic cavity 4 can effectively reduce a Q value (quality factor value) and sensitivity of a high-frequency resonance peak of the speaker box 100, which makes the acoustic performance of the speaker box 100 more excellent.

Compared with the relevant art, the speaker box of the present disclosure provides the auxiliary acoustic cavity 4 in communication with the front cavity 102 in the shell 1, so that the auxiliary acoustic cavity 4 serves as a portion of the front cavity 102 and acts as a resonant cavity, in one aspect, it effectively increases the cavity volume of the front cavity, and improves the high-frequency acoustic performance, in another aspect, the auxiliary acoustic cavity structure design is more flexible and diverse, and the applicability is higher, and the above structure can effectively reduce the Q value (quality factor value) and sensitivity of the high-frequency resonance peak of the speaker box, which makes the acoustic performance of the speaker box more excellent.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a shell having a receiving space;

a speaker, which is accommodated in the receiving space, wherein the speaker comprises a diaphragm for producing sound via vibrating, which partitions the receiving space into a front acoustic cavity and a rear cavity;

an acoustic guiding channel, which is defined in the receiving space and communicates the front acoustic cavity with the outside and forms a front cavity with the front acoustic cavity;

an auxiliary acoustic cavity, Which is formed in the shell and has a first through-hole in communication with the front cavity and a second through-hole in communication with the outside;

a baffle, which totally covers the first through-hole and is fixed thereat, wherein the baffle comprises a channel penetrating therethrough, the auxiliary acoustic cavity is in communication with the front cavity through the channel;

a cover plate, which totally covers the second through-hole and is fixed thereat.

2. The speaker box as described in claim 1, wherein the auxiliary acoustic cavity is in communication with the front acoustic cavity through the channel.

3. The speaker box as described in claim 1, wherein the channel has at least one of the rectangles shape, triangles shape and circles shape.

4. The speaker box as described in claim 1, wherein the number of the channel is two and the two channels are spaced apart from each other.

5. The speaker box as described in claim 1, wherein the cover plate is made of a PET material.

* * * * *